US010590722B2

(12) United States Patent
Searight et al.

(10) Patent No.: US 10,590,722 B2
(45) Date of Patent: Mar. 17, 2020

(54) DOWNHOLE APPARATUS AND METHOD OF USE

(71) Applicant: Halliburton Energy Services, Inc., Houston, TX (US)

(72) Inventors: Thomas Searight, Devizes (GB); William Chappel, Pewsey (GB); Keith Armstrong, Laurencekirk (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/785,413

(22) PCT Filed: Apr. 23, 2013

(86) PCT No.: PCT/GB2013/051267
§ 371 (c)(1),
(2) Date: Oct. 19, 2015

(87) PCT Pub. No.: WO2014/174288
PCT Pub. Date: Oct. 30, 2014

(65) Prior Publication Data

US 2016/0108690 A1 Apr. 21, 2016

(30) Foreign Application Priority Data

Apr. 23, 2013 (GB) ..... 1307271.5

(51) Int. Cl.
*E21B 23/02* (2006.01)
*E21B 23/01* (2006.01)
(Continued)

(52) U.S. Cl.
CPC ..... *E21B 23/01* (2013.01); *E21B 23/00* (2013.01); *E21B 23/02* (2013.01); *E21B 29/002* (2013.01); *E21B 33/129* (2013.01)

(58) Field of Classification Search
CPC ..... E21B 23/02; E21B 23/01; E21B 33/129; E21B 33/1291; E21B 33/1292; E21B 33/1293; E21B 33/1265
See application file for complete search history.

(56) References Cited

U.S. PATENT DOCUMENTS 2,964,110 A 12/1960 Garwood
3,344,862 A * 10/1967 Conrad ..... E21B 23/006 166/216

(Continued)

FOREIGN PATENT DOCUMENTS

EP 1241321 9/2002

OTHER PUBLICATIONS

International Search Report for PCT/GB2014/051267 dated Sep. 30, 2014.
EP14727025.0 , "Office Action", dated Feb. 18, 2019, 7 pages.

*Primary Examiner* — Cathleen R Hutchins
(74) *Attorney, Agent, or Firm* — Kilpatrick Townsend & Stockton LLP

(57) ABSTRACT

The invention provides a downhole apparatus (100) for positioning a tool or toolstring (10) in a wellbore and a method of use. The apparatus comprises a body (102) configured to be coupled to a tool or toolstring to be positioned in the wellbore. A plurality of support elements (108) is located on the body, the support elements comprising a first retracted position and a second open position. In the open position the support elements define one or more support surfaces. When the apparatus is lowered in a wellbore the one or more support surfaces of the support elements are configured to contact a restriction in the wellbore to support the apparatus in the wellbore and prevent downward movement of the apparatus in the wellbore past the restriction.

32 Claims, 5 Drawing Sheets

(51) Int. Cl.

| | |
|---|---|
| ***E21B 33/129*** | (2006.01) |
| ***E21B 23/00*** | (2006.01) |
| ***E21B 29/00*** | (2006.01) |

(56) References Cited

U.S. PATENT DOCUMENTS

| | | | | |
|---|---|---|---|---|
| 4,346,761 | A * | 8/1982 | Skinner | E21B 23/006<br>166/206 |
| 7,438,132 | B2 * | 10/2008 | Cook | E21B 7/208<br>166/207 |
| 2002/0150436 | A1 * | 10/2002 | Mason | E21B 23/01<br>409/143 |
| 2012/0298378 | A1 | 11/2012 | Mccauley | |
| 2013/0048287 | A1 | 2/2013 | Simson et al. | |

* cited by examiner

DOWNHOLE APPARATUS AND METHOD OF USE

CROSS-REFERENCE TO RELATED APPLICATIONS

This application claims priority to and the benefit of PCT Application No. PCT/GB2014/051267, filed Apr. 23, 2014, entitled "DOWNHOLE APPARATUS AND METHOD OF USE", which claims the benefit of and priority to Great Britain Patent Application No. GB1307271.5, filed Apr. 23, 2013, each of which is incorporated herein in its entirety.

The present invention relates to a downhole apparatus for use in hydrocarbon wells and a method of use, and in particular to a downhole apparatus for positioning a tool or toolstring within a wellbore and a method of use. Aspects of the invention relate to applications of the apparatus and method to the positioning of cutting equipment within a wellbore and to methods of cutting a downhole wellbore tubular.

BACKGROUND TO THE INVENTION

In the hydrocarbon exploration and production industry, it is common to position tools or toolstrings in a wellbore to perform intervention or workover operations. Wireline or slickline interventions convey the tool or toolstring from a flexible cable-like line which is controllably deployed from a powered winch.

Accurate positioning of tools within a wellbore is a commonly accepted limitation of wireline well intervention operations. The depth of a typical well, combined with the changes in deviation and azimuth along its length, mean that it may be difficult to calculate the position of the tools based simply on the length of the cable in the well to an accuracy within one or two feet (about 0.3 m to 0.6 m) using a distance encoder on the winch. One method used to improve accuracy involves electronically detecting joints between lengths of wellbore casing, the joints being at known positions. The winch encoder is then used to measure incremental depths from the last (or a recently passed) joint. However, this technique cannot reliably position a tool to within an accuracy of within one foot (around 0.3 m).

Inertial navigation tools such as those which use combinations of GPS receivers, accelerometers, gyroscopes, magnetometers and/or pressure sensors, may be able to improve on this accuracy, but they are expensive and not appropriate for the majority of well intervention operations.

The difficulties mentioned above have led to the development of equipment which utilise features in the wellbore to position a tool. These features may be designed into the completion for the express purpose of positioning tools. In this case, the completion will be designed to interact with a component carried on the toolstring to be positioned, so that the toolstring will not pass the wellbore feature. For example, the wellbore feature may simply be a restriction which is too small for a tool of a given diameter to pass. Alternatively, the wellbore feature may comprise a special profile so that a spring-loaded mechanism with a matching profile on the tool will automatically engage the profile as the tool passes.

Generally speaking, these types of wellbore features will only be positioned at a few specific points in the well and it is very unlikely that they will be of use for wireline interventions that had not been anticipated by the well designers. The lifetime of a well completion may be up to 20 years, and it is likely that new technology and intervention techniques will come into use between the design of the well and its ultimate abandonment.

It is also possible to utilise particular wellbore features that are designed into the wellbore completion for some other reason (other than tool positioning). However, as these wellbore features have not been designed with tool positioning in mind, the engagement mechanisms used may need to be relatively complex to effectively locate on them. In one typical scenario, a wellbore restriction of a first inner diameter, on which a sub-assembly of the toolstring is desired to locate, may be positioned beneath another restriction of second inner diameter, less than the first. In this situation, a subassembly which is able to pass the upper restriction of lesser inner diameter is not able to locate on the lower restriction.

Intervention tools have been proposed which use simple clamping mechanisms to position the tool on the inside of the casing. However, such tools do not address issues of accurate tool positioning.

One intervention technique that requires accurate tool placement is the use of electric cutting tools. These electric cutting tools provide a clean and controlled cut of downhole tubulars, and in one application are can be used to cut a sleeve inside a packer so as to allow it to be released and safely removed from a well. However in order to work the cutting tool must be positioned to an accuracy within 6 inches (around 0.15 m). This is often not within the operational capabilities of available intervention equipment, and in some applications it becomes necessary to adopt a different intervention approach requiring more rig time and expense.

There is generally a need for an apparatus for positioning a tool or toolstring within a wellbore and a method of use which addresses one or more of the problems identified above, and/or obviates or mitigates one or more drawbacks or disadvantages of the prior art.

In particular, one aim of an aspect of the invention is to provide an apparatus for positioning a tool or toolstring at a restriction in a wellbore, which is lower in the wellbore than a smaller restriction through which the apparatus is able to pass, and a method of use. It is an aim of an aspect of the invention to provide an assembly for cutting a downhole tubular incorporating a positioning apparatus and a method of use. Further aims and objects of the invention will become apparent from reading the following description.

SUMMARY OF THE INVENTION

According to a first aspect of the invention, there is provided a downhole apparatus for positioning a tool or toolstring in a wellbore, the apparatus comprising:

a body configured to be coupled to a tool or toolstring to be positioned in the wellbore;

a plurality of support elements located on the body, the support elements comprising a first retracted position and a second open position in which the support elements define one or more support surfaces;

wherein the apparatus is configured to be lowered in a wellbore with the support elements in their first retracted position, and is configured to be lowered in a wellbore with the support elements in their in their second, open position;

and wherein in their second open position, the one or more support surfaces of the support elements is configured to contact a restriction in the wellbore to support the apparatus in the wellbore and prevent downward movement of the apparatus in the wellbore past the restriction.

The support elements may be configured as slip assemblies.

Preferably, when the support elements are in their first retracted position, the maximum outer diameter of the apparatus is less than the inner diameter of an upper restriction in a wellbore in which the apparatus is to be deployed. Most preferably, when the support elements are in their first retracted position, the support elements are flush or fully retracted in the body.

The support elements may be urged outward into clamping engagement with the internal wall of a wellbore on encountering a restriction in the wellbore.

The support elements may be configured to contact an internal wall of a wellbore in their second open positions.

The support elements may comprise a friction reducing means, which may be a roller or a low-friction surface.

The apparatus may comprise a retaining mechanism for retaining the slip assemblies or support elements in the first, retracted position. The retaining mechanism may be a latch mechanism. The retaining mechanism may be biased towards a closed, latched position in which the slip assemblies are retained.

The retaining mechanism may be operable to be released by a sliding sleeve.

A slip assembly may comprise a slip member, which may be configured to move outwardly on an arrangement of co-operating slots and pins. Preferably, the slip member is configured to move upwardly and outwardly on the body. Thus a force on the slip member from a restriction in the wellbore which is disposed beneath the slip member may tend to force the slip member outwardly.

This enables the apparatus to hang-up, or be suspended on, a minor restriction in the wellbore, such as a small reduction in inner diameter at a casing coupling, which may be for example a restriction caused by swaging of a pin section of a casing coupling.

The angle between a longitudinal axis of the apparatus and the slots may be an acute angle, and may for example be between 5 degrees and 45 degrees. In a preferred embodiment, the angle between the longitudinal axis of the apparatus and the slots is between 5 degrees and 30 degrees, and more preferably is between 10 degrees and 20 degrees. A particular embodiment of the invention has an angle of approximately 15 degrees.

Preferably the apparatus comprises a mechanism for biasing the slip assemblies towards the second, open position. The mechanism may be a piston, which may be spring-biased.

The support elements may be configured to be retracted from the second, open position, for example on contact with an upper restriction during pulling of the apparatus from hole. A force on an upper part of a support element or slip assembly from a restriction or a shoulder may tend to close the support element or slip assembly against a biasing force and enable the apparatus to pass the restriction when moving in an upward direction.

According to a second aspect of the invention, there is provided a downhole apparatus for positioning a tool or toolstring in a wellbore, the apparatus comprising:

a body configured to be coupled to a tool or toolstring to be positioned in the wellbore;

a plurality of slip assemblies located on the body, the slip assemblies comprising a first retracted position and a second open position in which the slip assemblies contact an internal wall of a wellbore in use;

wherein the apparatus is configured to be lowered in a wellbore with the slip assemblies in their second, open position;

and wherein the slip assemblies in their second open position are configured to be urged outward into clamping engagement with the internal wall of a wellbore on encountering a restriction in the wellbore.

Embodiments of the second aspect of the invention may include one or more features of the first aspect of the invention or its embodiments, or vice versa.

According to a third aspect of the invention, there is provided an assembly for use in a wellbore tubular, the assembly comprising:

a downhole tool; and a positioning apparatus according to the first or second aspects of the invention coupled to the downhole tool.

The downhole tool may be a downhole electric cutting tool (DECT).

The downhole tool may comprise an anchoring or clamping mechanism. The anchoring or clamping mechanism may be coupled to a latch mechanism of the positioning apparatus. Preferably, initiation of the anchoring or clamping mechanism functions to release the latch mechanism.

The apparatus may comprise one or more adjuster mechanisms, operable to configure the longitudinal position of the downhole tool with respect to the positioning apparatus.

Embodiments of the third aspect of the invention may include one or more features of the first or second aspects of the invention or their embodiments, or vice versa.

According to a fourth aspect of the invention, there is provided method of positioning a tool at a downhole location, the method comprising:

providing a tool assembly comprising a tool or toolstring and a positioning apparatus coupled to the tool or toolstring, wherein the apparatus comprises a body and a plurality of support elements located on the body, the support elements comprising a first retracted position and a second open position in which the support elements define one or more support surfaces;

lowering the apparatus in a wellbore with the support elements in their second, open position to a restriction in the wellbore and causing the support elements to contact the restriction to support the apparatus in the wellbore and prevent downward movement of the apparatus in the wellbore past the restriction.

Preferably, the method comprises deploying the tool assembly with the slip assemblies in a first, retracted position. The method may comprise deploying the tool assembly past an upper restriction in the wellbore with the slip assemblies in a first, retracted position.

The method may comprise releasing a latch mechanism to enable the slip assemblies to move from the first retracted position and the second open position.

The method may comprise clamping the apparatus on a wellbore restriction. The wellbore restriction may be a restriction at a collar between lengths of casing in the wellbore.

Embodiments of the fourth aspect of the invention may include one or more features of the first to third aspects of the invention or their embodiments, or vice versa.

According to a fifth aspect of the invention, there is provided a method of positioning a tool at a downhole location, the method comprising:

providing a tool assembly comprising a tool or toolstring and a positioning apparatus coupled to the tool or toolstring, wherein the apparatus comprises a body and a plurality of slip assemblies located on the body, the slip assemblies comprising first retracted position and a second open position in which the slip assemblies contact an internal wall of a wellbore in use;

lowering the apparatus in a wellbore with the slip assemblies in their second, open position to a restriction in the wellbore and causing the slip assemblies to contact the restriction; urging the slip assemblies outward into clamping engagement with the internal wall of a wellbore by a force from the restriction on the slip assemblies.

Embodiments of the fifth aspect of the invention may include one or more features of the first to fifth aspects of the invention or their embodiments, or vice versa.

According to a sixth aspect of the invention, there is provided a method of cutting downhole wellbore tubular, the method comprising:

providing an assembly according to the third aspect of the invention;

positioning the assembly according to the method of the third aspect of the invention; operating the downhole electric cutting tool of the assembly to cut a downhole wellbore tubular.

The method may comprise releasing a latch mechanism to enable the slip assemblies to move from the first retracted position and the second open position. Releasing the latch mechanism may comprise initiating operation of an anchoring or clamping mechanism of the downhole electric cutting tool.

Embodiments of the sixth aspect of the invention may include one or more features of the first to fifth aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1:
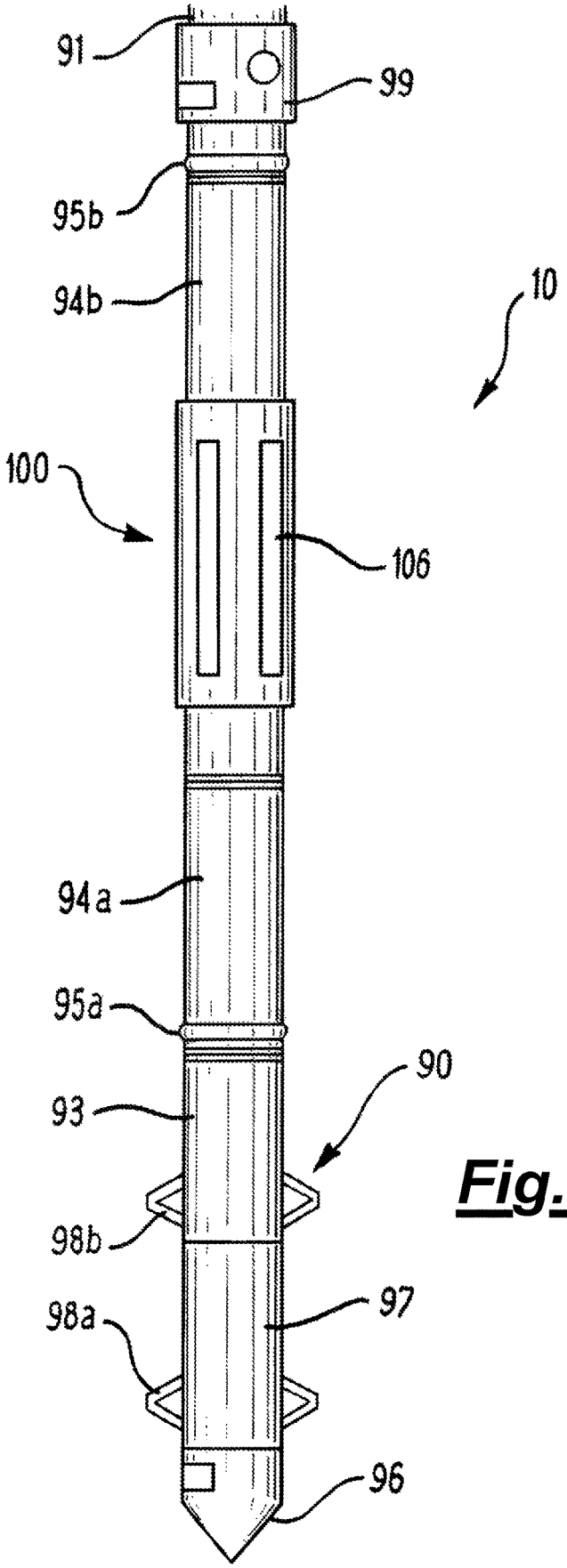
FIG. 1 is a schematic view of a part of a toolstring incorporating a cutting tool and a positioning apparatus according to an embodiment of the invention.

Referring firstly to FIG. 1, there is shown generally at 10 a toolstring for a wireline downhole intervention operation in a hydrocarbon well. The toolstring comprises a positioning apparatus shown generally at 100 (as will be described in more detail with reference to FIGS. 2 to 4) and a downhole electric cutting tool, generally shown at 90. The downhole electric cutting tool 90 is an example of a tool which is required to be accurately positioned in a wellbore, although it will be appreciated that the invention in at least some of its aspects has application to the positioning of other tools and toolstrings. In this example, the downhole electric cutting tool (DECT) is selected from those that are used in the oil and gas industry for the cutting of a sleeve located inside a wellbore or packer to allow it to be released and safely removed from a well.

The DECT is substantially tubular, and comprises at its upper end an upper expansion housing 91. The positioning apparatus 100 is secured into the DECT assembly via lower adjuster tube 94*a* and upper adjuster tube 94*b*. The adjuster tubes 94*a*, 94*b* are threaded at their upper and lower ends and couple to lower tube mount 93 and upper tube mount 99. The upper tube mount 99 are in this embodiment provided with ports which enables the DECT tool to fill with wellbore fluid during use. The threads enable adjustment of the longitudinal position of the cutter head 96 with respect to the positioning apparatus 100 prior to running to the toolstring. Lock rings 95*a* secure the position of the adjuster tubes when set.

The DECT comprises an anchoring mechanism and anchors 98*a* and 98*b* which are operable to fix the DECT with respect to the wellbore prior to cutting. Lower anchors 98*a* are disposed in a puller tube 97, and upper anchors 98*b* are located in slots (not shown) of the lower tube mount 93.

Figure 2:
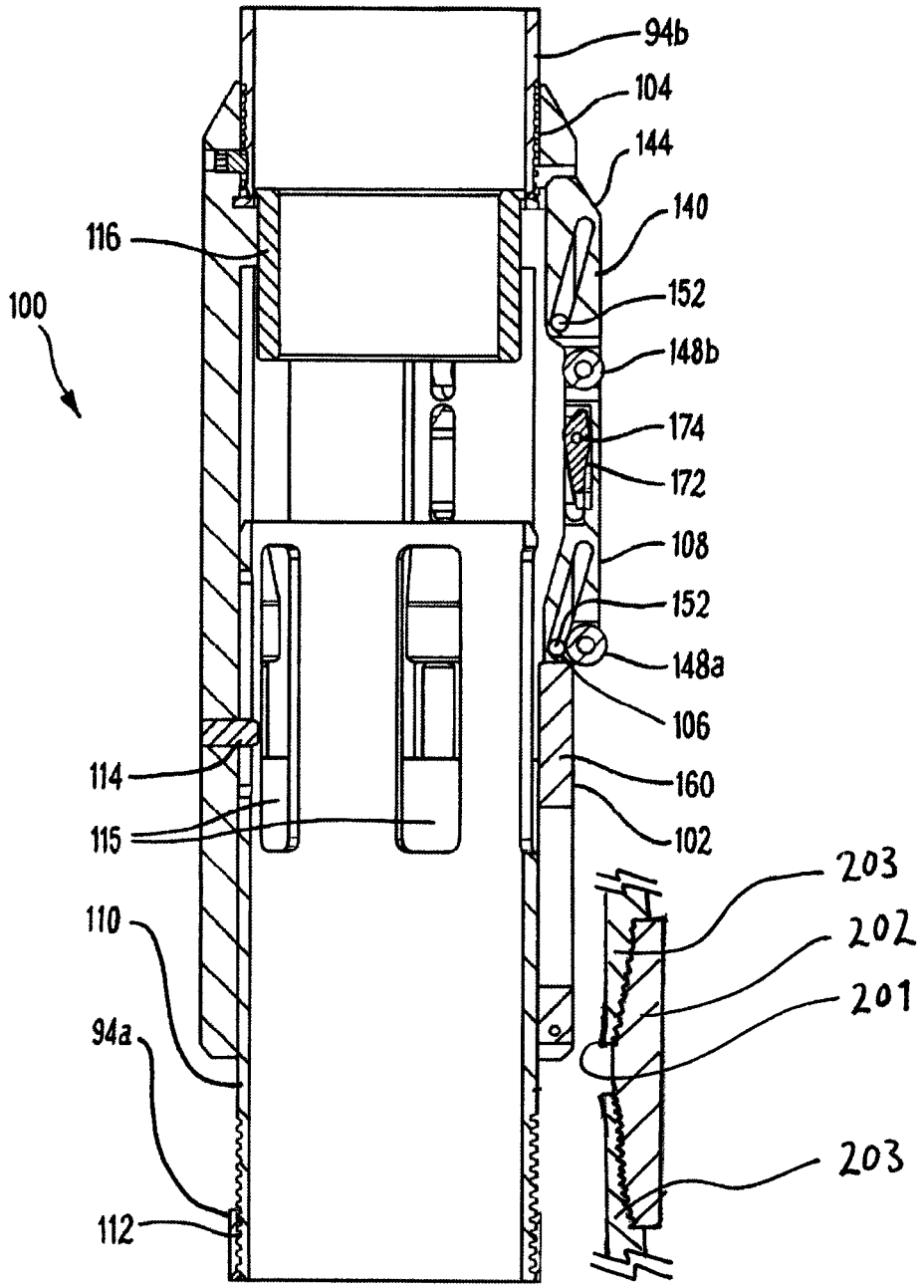
FIG. 2 is a longitudinal section through the positioning apparatus of FIG. 1 in an open condition.
Figure 3A:
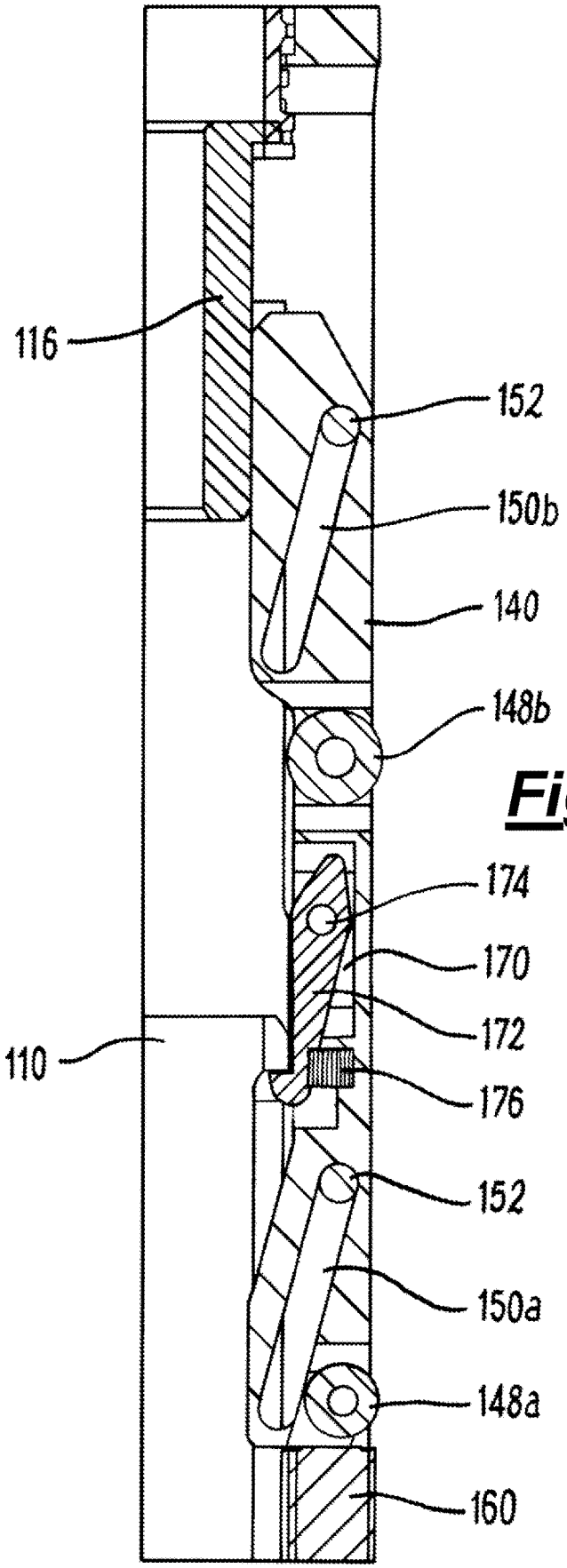
FIG. 3A is an enlarged sectional view of a slip assembly of the apparatus of FIGS. 1 and 2, shown in a latched, closed condition.
Figure 3B:
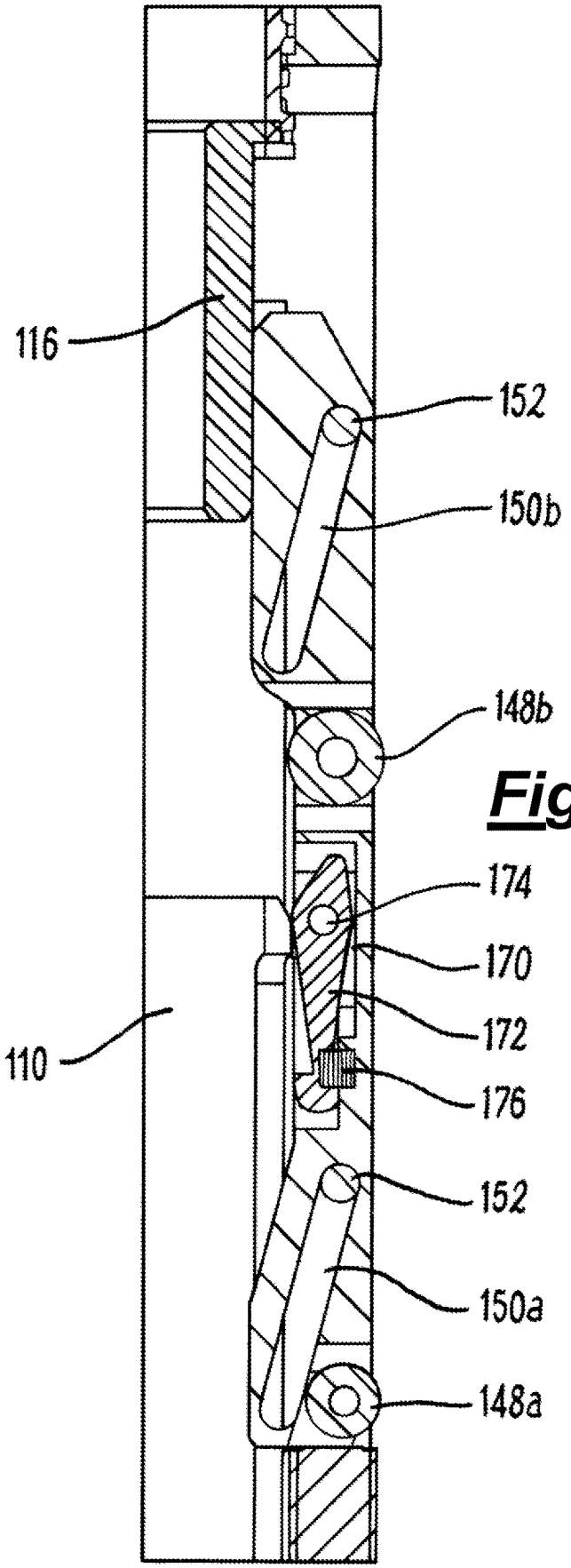
FIG. 3B is an enlarged sectional view of the slip assembly of the apparatus of FIGS. 1 and 2 in an unlatched, closed condition.
Figure 4:
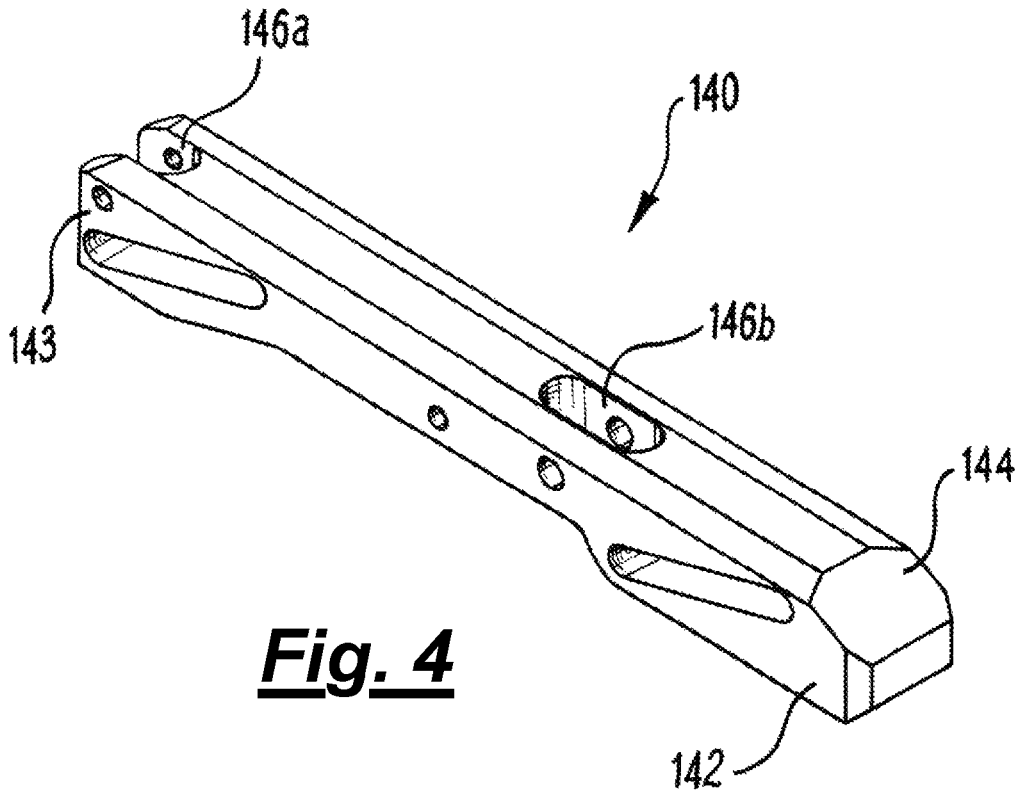
FIG. 4 is an isometric view of a slip element of the apparatus of FIGS. 1, 2 and 3.

Referring now to FIGS. 2 to 4, there is shown generally depicted at 100 the positioning apparatus according to an embodiment of the invention as used in the assembly 10 of FIG. 1. The apparatus 100 comprises a substantially tubular body 102 having an upper threaded end secured to the upper adjuster tube 94*b* via a threaded connection 104. The body, which in this case is formed from annealed stainless steel, comprises a number of slots 106 on the body 102 circumferentially spaced around the body. In this case five slots 106 are provided, although this may be fewer or greater in alternative embodiments. The slots 106 accommodate support elements in the form of slip assemblies, generally shown at 108, as will be described below.

The body 102 receives a tubular sleeve 110, which is operable to slide longitudinally within the body 102. A lower end of the tubular sleeve is threaded to the lower adjuster tube 94*a* by threaded connection 112. The sleeve 110 is rotationally keyed with the body 102 by pins 114 which extend into corresponding longitudinal slots (not shown) in the body 102. The pins 114 and slots function to align circumferentially arranged longitudinal slots 115 formed in the body 102 with slip assemblies 106, as described below. The tubular sleeve 110 is movable with respect to the body between a lower position in and an upper position in which the sleeve abuts an abutment surface provided by cylinder 116.

In the implementation shown in FIG. 1, the sleeve is mechanically coupled to the anchoring mechanism of the cutting tool, such that actuation of the anchor causes the sleeve to move within the body 102. The operation of the tool will be described in more detail below.

Slots 106 in the body accommodate support elements in the form of slip assemblies 108, which are shown in more detail in FIGS. 3A, 3B and 4. The slip assembly 108 comprises a slip member 140, which is a substantially longitudinal stainless steel block. An upper end 142 of the slip member comprises a chamfered leading end 144. Mounting recesses 146*a* and 146*b* are provided for lower and upper rollers 148*a*, 148*b* respectively. Angled slots 150*a* and 150*b* provide guides for the movement of the slip member 140 on pins 152 in the assembled slip assembly 108. The lower end 143 of the slip member is abutted by an energising piston 160, which forces the slip assembly to move upwards and outward in the slot 106. In this example, the energising piston is a spring energised piston which biases the slip assembly to an upwards and outwards position, as shown in FIG. 2.

Internally to each slip assembly 108 is a retaining mechanism in the form of a latch mechanism 170, comprising a latch member 172 mounted on a central pin 174. The latch member 172 is energised by a spring 176 to bias the latch towards an inner, latched position as shown in FIG. 3A. In the inner, latched position of FIG. 3A, the slip assembly 106 is accommodated in the slot 115, and therefore its retraction is not constrained by the sleeve 110.

A mode of operation of the toolstring will now be described, with reference to FIGS. 1 to 4, in the context of an application to the cutting of an interior sleeve of a wellbore packer for its release.

The toolstring 10 of FIG. 1A is run into a wellbore with the slip assemblies 108 in a retracted position, as shown in FIG. 3A, such that they are stowed in the slots 106 of the body 102. The slip assemblies 108 are retracted into the slots prior to deployment of the tool by applying an inward force to the slip assemblies against the force of the spring biased piston 160. With the tubular sleeve 110 in its lowermost position as shown in FIG. 3A, the upper ends of the slots 115 engage with the latch member 172 to retain the latch mechanism in a closed position. This prevents the slip assemblies from moving upwards and outwards in the slots 150*a*, 150*b* on pins 152 during run-in. In this retracted position, the tool is able to pass through a restriction in the wellbore (not shown) which is just a little larger than the outer diameter of the body 102 of the positioning apparatus (but smaller than the diameter of the tool with the slips open).

When the toolstring has passed the restriction, the slip assemblies can be released from their closed, latched position. This is achieved by commencing operation of the anchoring or clamping mechanism which is operable to cause the anchors 98*a*, 98*b* to move outwards towards a position in which they would clamp against the wellbore. The actuation mechanism for the anchors 98*a*, 98*b* is coupled to the tubular sleeve 110. Setting of the anchoring mechanism, initiated in this example by pulling upwards on the DECT puller tube 97 causes upward movement of the sleeve 110. Before the anchors are open far enough to contact the interior wall of the wellbore, and as shown in FIG. 3B, the sleeve 110 has moved upwardly in the positioning apparatus 100 to release the latch member 172 from its respective slot 115 on the sleeve 110. The latch mechanism 170 is therefore disengaged from the slot in the sleeve, which allows the slip assemblies to move upwardly and outwardly along the path of the slots 150*a*, 150*b* on the pins 152. The latch member 172 is clear of the slots, allowing the tubular sleeve 110 to move upwards or downwards without interacting with the slips. This allows the anchoring mechanism to be decoupled from the movement of the slips, and prevents unintentional loading of the clamping mechanism from the positioning apparatus 100.

With the slip assemblies released, the toolstring is able to move upwards or downwards along the smooth tubular. The spring force from the piston 160 causes the slip assemblies to move upwards and outwards. Friction from the tubular wall will also tend to cause the slips to move upwards and outwards. The rollers 148*a* and 148*b* reduce the friction sufficiently to enable the tool to move upwards and downwards in the tubular to the required position without the slip assemblies being forced outward and into clamping engagement with the tubing.

As the toolstring is lowered in the well under its own weight, a restriction encountered in the wellbore tends to force the slips outward to provide a clamping force on the toolstring in the wellbore at that particular location. The angle of the slots 150*a*, 150*b* on which the pins 152 of the slip assemblies move, is selected so that even a minor restriction 201, such as a reduction in wellbore inner diameter found at the collars 202 between lengths of casing 203 in the well (for example caused by swaging during manufacture of the box or pin thread sections), will cause this clamping action and hold up the toolstring at that particular location. In this embodiment, the selected angle is approximately 15 degrees.

Increasing the angle between longitudinal axis of the apparatus and the angle of the slots will reduce the radial clamping force provided by friction between pipe wall and slips. Reducing the angle provides an increased clamping force but increases the required length of the device.

In practice the angle may be optimised for different wellbore scenarios (such as the possible length or weight of the apparatus and the size of the restrictions to be encountered in the wellbore tubing).

In addition, the distance at which the rollers 148*a*, 148*b* protrude beyond the outer diameter defined by the slip members 140, is selected to be less than a typical reduction in wellbore inner diameter found at the collars between links of casing.

This configuration facilitates positioning of the toolstring at or adjacent an appropriate casing joint near the cutting location, using conventional techniques such as winch encoder positioning. The DECT puller tube can then be moved upwards in the tool to initiation movement of the DECT anchors and release the slip assemblies from the closed, latched position as described above with reference to FIGS. 3A and 3B. The positioning apparatus 100 can then be accurately positioned on the casing joint by sliding the toolstring to the restriction.

The restriction is a known distance from the required cutting location, and the tool has been preconfigured to place the cutting head at the required height. With the tool positioned on the restriction, the DECT anchoring mechanism can be set as normal to clamp the cutting tool against the wellbore. In particular, further movement upwards of the puller tube does not affect the position of the slips as the tubular sleeve 110 has been decoupled from the latch mechanism of the slips as described above. With the anchoring mechanism in place, the cutting operation can be performed to cut the sleeve of the packer element at a precisely known location.

When the cutting operation is complete, the clamp arms of the anchoring mechanism can be fully retracted, which causes the downward movement of the tubular sleeve 110. The piston 160 tends to retain the slips in the outward position shown in FIG. 2. However, when an upward pulling force is applied to the assembly via the wireline cable, friction on the slips will tend to retract the slips against the spring force. With the anchoring mechanism clamps fully retracted, any downward force on the slips from a restriction (for example the upper wellbore restriction through which the toolstring was initially passed), forces the slips inwards via the chamfered face 144, and towards the latched, closed position. This enables the toolstring to be easily removed from the wellbore.

In a downhole electric cutting application, the DECT cutter tool is likely to include a safety shear pin mechanism configured such that any tension applied to the top of the tool is always applied through the shear pins. This enables the anchors of the DECT to be released in the event of a power failure. The positioning apparatus does not prevent a shear pin release mechanism from functioning: any tension applied to the top of the apparatus is transferred directly through the shear pins of the DECT, and if sufficient pull is applied the pins will shear and allow a slip joint on the DECT tool to extend. This acts to release the drive to the anchor mechanism and enables the tool to be withdrawn from the well.

Although the above-described embodiment is coupled to a wireline or other flexible conveyance, it will be appreciated that the principals of the invention may also be applied to other types of conveyance system, including but not limited to coiled-tubing and drill pipe conveyance.

Although the embodiments described above rely upon movement of a sleeve from an existing power source (namely the anchoring mechanism) the apparatus could be activated from a retracted position to an extended or deployed condition by other means in alternative embodiments. For example, in an alternative embodiment, the deployment and or retraction of the support elements of the apparatus could be activated by an electric motor attached to a drive screw. Rotation of the motor would be converted to linear movement, which would cause the support elements to be released from a retaining mechanism. Alternatively, deployment could be activated by a hydraulically actuated piston such that as the piston is moved under hydraulic power, the retaining mechanism is released. In such a configuration, hydraulic power could be provided internally, for example by a hydraulic power source such as an electric motor driving either a pump or additional piston. Alternatively, hydraulic power could come from a surface system and be pumped down to the tool via tubing or a hydraulic control line. The linear movement required to release a retaining mechanism could also be provided by using the stored energy within the well fluid. In such a configuration, a burst disc could be set to fracture at a given pressure, allowing the well fluid to fill a void and draw a piston member into the void. Other mechanisms may be used in alternative embodiments of the invention.

The invention provides a downhole apparatus for positioning a tool or toolstring in a wellbore and a method of use. The apparatus comprises a body configured to be coupled to a tool or toolstring to be positioned in the wellbore. A plurality of support elements is located on the body, the support elements comprising a first retracted position and a second open position. In the open position the support elements define one or more support surfaces. When the apparatus is lowered in a wellbore the one or more support surfaces of the support elements are configured to contact a restriction in the wellbore to support the apparatus in the wellbore and prevent downward movement of the apparatus in the wellbore past the restriction.

In one particular configuration, the support elements are a plurality of slip assemblies located on the body, each slip assembly comprising first retracted position and a second open position. In the open position the slip assemblies contact an internal wall of a wellbore, and the apparatus is lowered in a wellbore. The slip assemblies in their second open position are configured to be urged outward into clamping engagement with the internal wall of a wellbore on encountering a restriction in the wellbore, which may be a slight restriction such as those found at casing couplings. The apparatus and method enables precise positioning of downhole equipment such as cutting tools. The apparatus may also enable the tool to be deployed past a larger, upper restriction, with the slips in their retracted position.

Various modifications to the above-described embodiments may be made within the scope of the invention, and the invention extends to combinations of features other than those expressly claimed herein.

The invention claimed is:

1. A downhole apparatus for positioning a tool or toolstring in a wellbore, the wellbore having an upper restriction with an inner diameter less than a wellbore inner diameter, the apparatus comprising:

a body configured to be coupled to a tool or toolstring to be positioned in the wellbore;

a plurality of support elements located on the body, the support elements defining one or more support surfaces, wherein the support elements comprise a retracted position in which the apparatus is configured to be lowered in the wellbore, and in which a maximum outer diameter of the apparatus is less than the inner diameter of the upper restriction; and a plurality of rollers positioned on the body to enable the apparatus to move upwards and downwards in the wellbore while maintaining the plurality of support elements in a set position, the plurality of rollers further comprising at least two rollers of the plurality of rollers spaced longitudinally along each support element of the plurality of support elements;

wherein, with the support elements in the set position the apparatus is configured to be lowered in the wellbore to present the one or more support surfaces to a second lower restriction in the wellbore after the support elements have been opened to the set position; and wherein in the set position, the one or more support surfaces of the support elements are configured to contact the second lower restriction in the wellbore to support the apparatus in the wellbore and prevent downward movement of the apparatus in the wellbore past the second lower restriction.

2. The apparatus according to claim 1, wherein when the support elements are in their retracted position, the support elements are flush or fully retracted in the body.

3. The apparatus according to claim 1, wherein the support elements are configured to be urged outward into clamping engagement with the internal wall of the wellbore on encountering the second lower restriction in the wellbore.

4. The apparatus according to claim 1, wherein the support elements are configured to contact an internal wall of the wellbore in the set position.

5. The apparatus according to claim 1, further comprising a retaining mechanism for retaining the support elements in the retracted position.

6. The apparatus according to claim 5, wherein the retaining mechanism is a latch mechanism, and the latch mechanism is biased towards a closed, latched position in which the support elements are retained.

7. The apparatus according to claim 5, wherein the retaining mechanism is operable to be released by a sliding sleeve.

8. The apparatus according to claim 1, wherein the support elements comprise slip assemblies.

9. The apparatus according to claim 1, wherein at least one of the support elements comprises a slip member, configured to move outwardly on an arrangement of co-operating slots and pins.

10. The apparatus according to claim 9, wherein the slip member is configured to move upwardly and outwardly on the body.

11. The apparatus according to claim 9, wherein a force on the slip member from the second lower restriction in the wellbore which is disposed beneath the slip member tends to force the slip member outwardly.

12. The apparatus according to claim 9, wherein an angle between a longitudinal axis of the apparatus and the slots is between 5 degrees and 45 degrees.

13. The apparatus according to claim 12, wherein the angle between the longitudinal axis of the apparatus and the slots is between 10 degrees and 20 degrees.

14. The apparatus according to claim 1, wherein the apparatus comprises a mechanism for biasing the support elements towards the set position.

15. The apparatus according to claim 14, wherein the mechanism is a spring-biased piston.

16. The apparatus according to claim 1, wherein the support elements are configured to be retracted from the set position.

17. An assembly for use in a wellbore tubular, the assembly comprising:

a downhole tool; and a positioning apparatus according to claim 1 coupled to the downhole tool.

18. The assembly according to claim 17 wherein the downhole tool is a downhole electric cutting tool (DECT).

19. The assembly according to claim 17, wherein the downhole tool comprises an anchoring or clamping mechanism.

20. The assembly according to claim 19 wherein the anchoring or clamping mechanism is coupled to a retaining mechanism of the positioning apparatus.

21. The assembly according to claim 20 wherein initiation of the anchoring or clamping mechanism functions to release the retaining mechanism.

22. The assembly according to claim 20 wherein the retaining mechanism comprises a latch mechanism.

23. The assembly according to claim 17, wherein the positioning apparatus comprises one or more adjuster mechanisms, operable to configure a longitudinal position of the downhole tool with respect to the positioning apparatus.

24. A method of positioning a tool at a downhole location, the method comprising:

providing a tool assembly comprising a tool or toolstring and a positioning apparatus coupled to the tool or toolstring, wherein the apparatus comprises a body and a plurality of support elements located on the body, the support elements comprising a retracted position and a set position the support elements define one or more support surfaces;

lowering the apparatus in a wellbore during a first lowering phase past an upper restriction in the wellbore with an inner diameter less than a wellbore inner diameter, in which the support elements are in the retracted position, wherein a maximum outer diameter of the apparatus is less than the inner diameter of the upper restriction;

opening the support elements to the set position;

after opening the support elements to the set position, lowering the apparatus in the wellbore during a second lowering phase towards a second lower restriction in the wellbore, with the support elements in the set position and while using a plurality of rollers positioned on the body to enable the apparatus to be lowered in the wellbore while maintaining the plurality of support elements in the set position; and bringing the support elements into contact with the second lower restriction in the wellbore, thereby supporting the apparatus in the wellbore and preventing downward movement of the apparatus in the wellbore past the second lower restriction.

25. The method according to claim 24 comprising releasing a retaining mechanism to enable the support elements to move from the retracted position to the set position.

26. The method according to claim 25 wherein initiation of an anchoring or clamping mechanism of the tool or toolstring functions to release the retaining mechanism.

27. The method according to claim 24 comprising clamping the apparatus at the second lower restriction.

28. The method according to claim 27 wherein the second lower restriction is a restriction at a collar between lengths of casing in the wellbore.

29. The method according to claim 27 wherein the second lower restriction is a restriction caused by swaging of a pin section of a length of casing.

30. A method of cutting a downhole wellbore tubular, the method comprising:

providing a tool assembly comprising a tool or toolstring and a positioning apparatus coupled to the tool or toolstring, wherein the apparatus comprises a body and a plurality of support elements located on the body, the support elements comprising a retracted position and a set position the support elements define one or more support surfaces;

lowering the apparatus in a wellbore during a first lowering phase past an upper restriction in the wellbore with an inner diameter less than a wellbore inner diameter, in which the support elements are in the retracted position, wherein a maximum outer diameter of the apparatus is less than the inner diameter of the upper restriction;

opening the support elements to the set position;

after opening the support elements to the set position, lowering the apparatus in the wellbore with the support elements in the set position to a second lower restriction in the wellbore while using a plurality of rollers positioned on the body to enable the apparatus to be lowered in the wellbore while maintaining the plurality of support elements in the set position, and subsequently causing the support elements to contact the second lower restriction to support the apparatus in the wellbore and prevent downward movement of the apparatus in the wellbore past the second lower restriction; and operating a downhole electric cutting tool of the assembly to cut a downhole wellbore tubular.

31. The method according to claim 30, comprising releasing a retaining mechanism to enable the support elements to move from the retracted position and the set position.

32. The method according to claim 31, comprising releasing the retaining mechanism by initiating operation of an anchoring or clamping mechanism of the downhole electric cutting tool.

* * * * *